US012188662B2

(12) United States Patent
Yu

(10) Patent No.: US 12,188,662 B2
(45) Date of Patent: Jan. 7, 2025

(54) COOKING APPLIANCE

(71) Applicant: LG ELECTRONICS INC., Seoul (KR)

(72) Inventor: Cheong Hwan Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 121 days.

(21) Appl. No.: 17/484,434

(22) Filed: Sep. 24, 2021

(65) Prior Publication Data

US 2022/0099305 A1 Mar. 31, 2022

(30) Foreign Application Priority Data

Sep. 25, 2020 (KR) ..... 10-2020-0125073

(51) Int. Cl.
*F24C 15/02* (2006.01)

(52) U.S. Cl.
CPC ..... *F24C 15/021* (2013.01)

(58) Field of Classification Search
CPC ..... F24C 15/021; F24C 15/023; F24C 15/12; F24C 15/14; A47J 37/0623; A47J 36/027
USPC ..... 126/19 R
See application file for complete search history.

(56) References Cited

U.S. PATENT DOCUMENTS 4,295,261 A * 10/1981 Scherer ..... F24C 15/021 29/451
10,688,327 B2 * 6/2020 Johnson ..... A62C 4/00
2006/0273700 A1 * 12/2006 Gornoll ..... F25D 23/02 312/116
2011/0186029 A1 * 8/2011 Swayze ..... E05D 15/00 49/70
2017/0051922 A1 * 2/2017 Kaiser ..... F24C 15/021
2021/0348768 A1 * 11/2021 Weber ..... F24C 15/021

FOREIGN PATENT DOCUMENTS

DE 29922260 U1 * 3/2000 ..... F24C 15/006
DE 202016103077 U1 8/2016
EP 2716977 A1 * 4/2014 ..... F24C 11/00
WO WO-2019066280 A1 * 4/2019 ..... F24C 15/006

* cited by examiner

*Primary Examiner* — Allen R. B. Schult
*Assistant Examiner* — William C Weinert
(74) *Attorney, Agent, or Firm* — Bryan Cave Leighton Paisner LLP

(57) ABSTRACT

A cooking appliance in one embodiment may include a main body provided therein with a cooking space, a door configured to open and close the cooking space, a packing member disposed at an entrance of the cooking space and configured to seal a gap that is created in a portion where the main body contacts the door with the door closed, and a bracket coupled to a lower portion of the door and to suppress contact between the packing member and a foreign substance moving to the lower portion of the door with the door closed.

14 Claims, 7 Drawing Sheets

COOKING APPLIANCE

CROSS-REFERENCE TO RELATED APPLICATION

This application claims priority to and the benefit of Korean Patent Application No. 10-2020-0125073, filed on Sep. 25, 2020, the disclosure of which is incorporated herein by reference in its entirety.

TECHNICAL FIELD

Disclosed herein is a cooking appliance, and in particular, a cooking appliance having a structure that ensures improvement in durability.

BACKGROUND

Details in the background section do not constitute the related art but are given only as background information concerning the subject matter of the present disclosure.

Cooking appliances, one of the home appliances, are installed in the kitchen and cook food as a user wants. The cooking appliances can fall into different categories, based on a heat source or a type, and the sort of a fuel.

The cooking appliances can be categorized into an open cooking appliance in which food is placed in an open space, and a sealed cooking appliance in which food is placed in a closed space, based on a way of cooking food. The sealed cooking appliance includes an oven, a microwave oven and the like, and the open cooking appliance includes a cooktop, a hob, and the like.

In the sealed cooking appliance, a space, in which a food item is placed, is shielded, and the shielded space is heated to cook the food item. The sealed cooking appliance is provided with a cooking space in which a food item is placed and which is shielded when the food item is cooked. In the cooking space, a food item is actually cooked. A heat source is disposed inside or outside the cooking space to heat the cooking space.

The sealed cooking appliance is provided with a door that selectively opens and closes the cooking space in a rotatable manner. The door is installed in a main body in a rotatable manner through a door hinge and rotates around a portion in which the door is coupled to the main body to selectively open and close the cooking space.

A heat source is disposed in an inner space of the cooking space opened and closed by the door, to heat the cooking space. The heat source includes a gas burner or an electric heater and the like.

When a food item is put into the cooking space of the cooking appliance and cooked in a high temperature atmosphere, a large amount of foreign substances such as fat and the like can be produced from the food item. In particular, when meat such as a chicken is cooked at a high temperature, a large amount of fat can be produced from the meat.

To suppress an escape of the foreign substances out of the cooking space, a packing can be provided for the cooking space.

However, when a high-temperature foreign substance contacts the packing, the packing can be corroded or damaged by the high-temperature foreign substance. The corrosion and damage of the packing, caused by the high-temperature, can result in a reduction in sealing performance of the packing. Accordingly, the high-temperature foreign substance can escape from the cooking space, causing injuries to a user.

Under the circumstances, there is a growing need for a cooking appliance having an improved structure that helps to suppress direct contact between the packing and the high temperature to ensure good sealing performance of the packing provided for the cooking space.

SUMMARY

Technical Problem

The object of the present disclosure is to provide a means to suppress high-temperature foreign substance-driven melting, deformation or damage of a packing member disposed in a cooking appliance.

According to the disclosure, the cooking appliance is provided with a bracket to suppress the piling of high-temperature foreign substances, flowing down to a lower portion of an inner glass, on a lower frame of the packing member.

The object of the present disclosure is to provide a cooking appliance in which the bracket has a plurality of bent portions and closely contacts a door such that the cooking appliance has a structure that suppresses contact between high-temperature foreign substances, flowing down to the inner glass of the door, and the lower frame of the packing.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solution

A cooking appliance in one embodiment may include a main body provided with a cooking space, a door configured to open and close the cooking space, a packing member disposed at an entrance of the cooking space and configured to seal a gap between the main body and the door, and a bracket which is disposed on an upper side of a lower frame disposed in a lower end portion of the packing member and is configured to block a foreign substance from directly contacting the lower frame with the door closed.

Since the bracket has a plurality of bent portions, the bracket may change a flow direction of a liquid-or-gel-phase foreign substance flowing down from an inner surface of the door and having high fluidity to suppress contact between the lower frame and the foreign substance that continues to flow down to a lower end portion of the door through a gap of a portion where the bracket contacts the door because of gravity.

At least a portion of the plurality of bent portions of the bracket may closely contact the inner surface of the door. Accordingly, the gap of the contact portion between the bracket and the door may be removed or significantly narrowed, to suppress the foreign substance from permeating through the gap of the contact portion between the bracket and the door.

A cooking appliance in one embodiment may include a main body provided therein with a cooking space, a door configured to open and close the cooking space, a packing member disposed at an entrance of the cooking space and configured to seal a gap that is created in a portion where the main body contacts the door with the door closed, and a bracket coupled to a lower portion of the door and to suppress contact between the packing member and a foreign substance moving to the lower portion of the door with the door closed.

The bracket may include a base part coupled to the lower portion of the door, and an additional edge part connected to the base part, formed to protrude in a front-rear direction of the main body with the door closed, and configured to cover an upper surface of the packing member.

The bracket may further include a first bent part connected to the base part and bent with respect to the base part, a second bent part bent and extended from the first bent part, and a third bent part bent and extended from the second bent part and having one end connected to the additional edge part.

The additional edge part may be disposed further upward than a lower end portion of the packing member with the door closed.

The bracket may be integrally formed in a way that a plate is bent, and the additional edge part may be provided with a folded portion, in which a plate is folded in two in a certain portion such that one plate contacts another plate, in an end portion thereof.

A portion of the folded portion may be disposed at the end of the additional edge part, and the end of the additional edge part may be rounded.

An angle formed by the second bent part and the third bent part of the bracket may be an acute angle, and in a state in which the bracket is coupled to the door, at least a portion of one surface of the third bent part may closely contact an inner glass mounted onto the door.

The base part may include a first cell bent from the first bent part, and a pair of second cells bent in both end portions of the first bent part respectively and elongated further than the first cell, and the second cell may be provided with a first coupling hole for a coupling with the door, and the door may be provided with a second coupling hole for a coupling of the base part in a portion corresponding to the first coupling hole.

The first bent part may be provided with a third coupling hole for a coupling with the door, the third coupling hole formed in a direction across a direction in which the first coupling hole is formed, and the door may be provided with a fourth coupling hole for a coupling of the first bent part in a portion corresponding to the third coupling hole.

The door may include a locker disposed on both sides of the bracket, spaced from the bracket and configured to keep the door closed, a first frame onto which the locker is mounted, which has a space in a central portion thereof, and at which the bracket is disposed, a second frame disposed in an edge portion of the first frame, a third frame having a space in a central portion thereof, surrounding the first frame and the second frame and forming an exterior of the door, a handle mounted onto the third frame, an outer glass disposed in the central portion of the third frame and disposed outside the door, and an inner glass disposed in the central portion of the first frame and disposed inside the door.

The additional edge part may be disposed higher than a lower end of the inner glass with the door closed.

One surface of the base part may be disposed to face a lower end surface of the door, and at least a portion of one surface of the first bent part may closely contact an inner surface of the door.

One surface of the second bent part may be disposed to face a lower end surface of the inner glass, and at least a portion of one surface of the third bent part may closely contact one surface of the inner glass.

A cooing appliance in another embodiment may include a main body provided therein with a cooking space, a door configured to open and close the cooking space and including a first frame having a space in a central portion thereof, a second frame disposed in an edge portion of the first frame, a third frame having a space in a central portion thereof, surrounding the first frame and the second frame and forming an exterior of the door, an outer glass disposed in the central portion of the third frame and an inner glass disposed in the central portion of the first frame, a packing member disposed at an entrance of the cooking space and configured to seal a gap that is created in a portion where the main body contacts the door with the door closed, and a bracket coupled to a lower portion of the door and to suppress contact between the packing member and a foreign substance moving to the lower portion of the door with the door closed.

The bracket may include a base part coupled to the lower portion of the door, an additional edge part connected to the base part, formed to protrude in a front-rear direction of the main body with the door closed and configured to cover an upper surface of the packing member, a first bent part connected to the base part and bent with respect to the base part, a second bent part bent and extended from the first bent part and a third bent part bent and extended from the second bent part and having one end connected to the additional edge part.

The bracket may be integrally formed in a way that a plate is bent, and the additional edge part may be provided with a folded portion, in which a plate is folded in two in a certain portion such that one plate contacts another plate, in an end portion thereof, and the end of the additional edge part may be rounded.

The additional edge part may be further upward than a lower end portion of the packing member with the door closed, and an angle formed by the second bent part and the third bent part of the bracket may be an acute angle, and in a state in which the bracket is coupled to the door, at least a portion of one surface of the third bent part may closely contact an inner glass mounted onto the door.

One surface of the base part may be disposed to face a lower end surface of the door, at least a portion of one surface of the first bent part may closely contact an inner surface of the door, one surface of the second bent part may be disposed to face a lower end surface of the inner glass, and at least a portion of one surface of the third bent part may closely contact one surface of the inner glass.

Advantageous Effect

A cooking appliance according to the present disclosure may be provided with a bracket that is disposed in a portion, corresponding to a packing member in an up-down direction, in a lower portion of an inside of a door with the door closed and disposed further upward than a lower end portion of the packing member, such that the bracket effectively suppresses piling of a high-temperature foreign substance, flowing down from an inner surface, i.e., an inner glass of the door, in a lower end portion of the packing member.

Accordingly, the packing member's melting, deformation or damage, caused by direct contact between the high-temperature foreign substance and the packing member may be effectively suppressed.

The cooking appliance according to the disclosure may be provided with a folded portion at an additional edge part of the packing member, and the folded portion may be twice or greater thicker than a plate used for the additional edge part, to effectively suppress the additional edge part's deformation or damage caused by an external impact.

The cooking appliance according to the disclosure may be provided with the additional edge part of the packing member, the end of which is not thin and sharp but thick and rounded as described above, to effectively suppress injuries of a body part of the user even when the body part contacts the end of the additional edge part.

The cooking appliance according to the disclosure may be provided with the bracket having a plurality of bent portions. When the bracket is firmly coupled to the door, the bent portions may closely contact a surface of the door or be disposed in an approximately horizontal direction with respect to the cooking appliance, to effectively suppress a flow of a high-temperature foreign substance, flowing down along a surface of the inner glass, to the packing member along a gap of a portion in which the bracket contacts the door.

Specific effects are described along with the above-described effects in the section of detailed description.

BRIEF DESCRIPTION OF DRAWING

The accompanying drawings constitute a part of the specification, illustrate one or more embodiments in the disclosure, and together with the specification, explain the disclosure, wherein.

DETAILED DESCRIPTION

Figure 1:
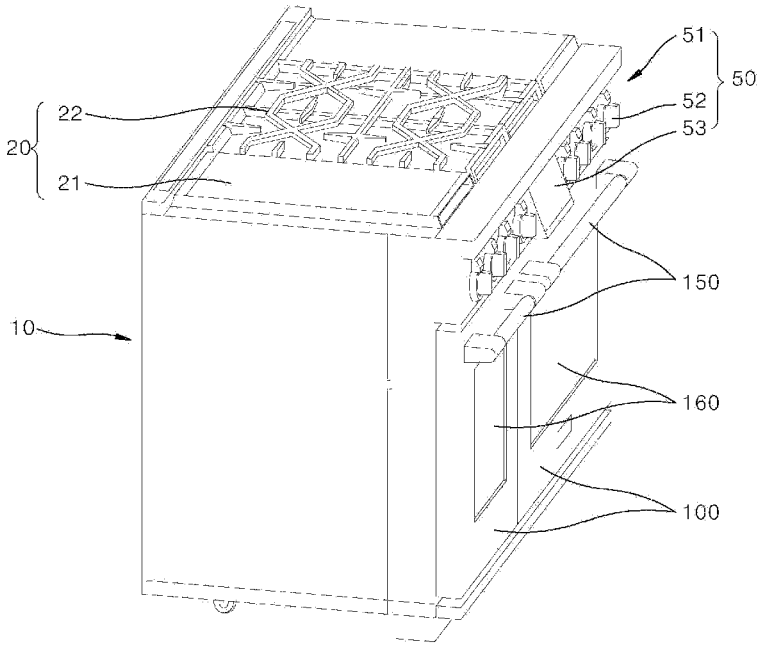
FIG. 1 is a perspective view showing a cooking appliance in one embodiment.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Figure 2:
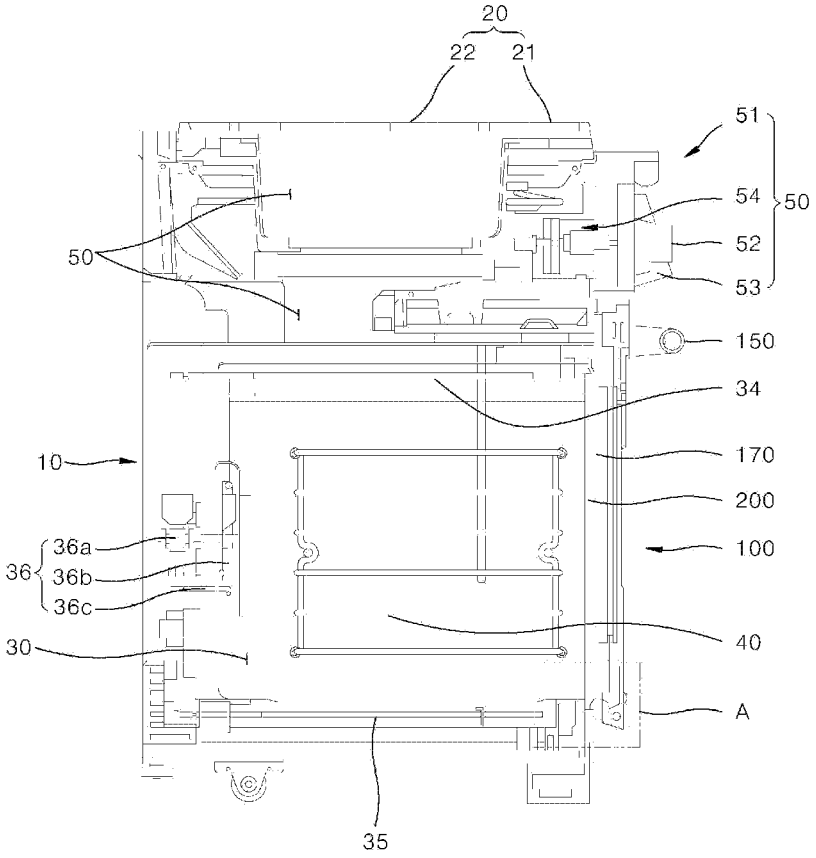
FIG. 2 is a cross-sectional view showing the cooking appliance in one embodiment.

FIG. 1 is a perspective view showing a cooking appliance in one embodiment. FIG. 2 is a cross-sectional view showing the cooking appliance in one embodiment.

The cooking appliance in the embodiment may be provided with two cooking spaces 30. Accordingly, the cooking appliance may be provided with two doors 100 configured to open and close each of the cooking spaces 30 respectively. In this case, the cooking appliance may be provided with two brackets 300 in the embodiment.

The two cooking spaces 30 and the two doors 100 may have the same or a similar structure except that the two cooking spaces 30 and the two doors 100 have different widths. Accordingly, the two brackets 300 in the embodiment may have the same or a similar structure except that the two brackets 300 have a different length respectively to correspond to the widths of the cooking spaces 30.

Hereunder, described are a structure of a cooking space 30 having a relatively small width, a structure of a door 100 having a relatively small width and corresponding to the cooking space 30, and a bracket 300 having a relatively small length and mounted onto the door 100, at a front in FIG. 1.

Referring to FIGS. 1 and 2, a main body 10 may form an exterior of the cooking appliance in one embodiment. The main body 10 may be provided therein with the cooking space 30 and have a shape including an approximately rectangular cuboid shape, and may be made of a material having a predetermined strength to protect a plurality of components installed in an inner space thereof.

The main body 10 may be provided with a cooktop part 20 configured to heat food or a vessel containing food and cook the food, in an upper end portion thereof. The cook top part 20 may be provided with an upper plate 21 that forms an exterior of an upper surface of the cooking appliance and closes the upper end of the main body 10.

The cooktop part 20 may be provided with one or more heating parts 22 for heating food to be cooked or a vessel containing food to be cooked, in a central portion thereof. The heating part 22 may be a heating device that uses gas as a fuel in one example. In another example, the heating part 22 may be an induction heater that uses electricity. The heating part 22 may have different structures depending on the sort of heat sources.

Additionally, the cooktop part 20 may be provided with the cooking space 30 serving as a space in which food is cooked, on a lower side thereof.

The cooking space 30 may be formed into a rectangular cuboid, a front surface of which is open. In a state in which the cooking space 30 is shielded, an inner space of the cooking space 30 may be heated to cook food.

The cooking space 30 may be provided with an upper heater 34 configured to heat the inner space of the cooking space 30 from above, on an upper side thereof, and may be further provided with a lower heater 35 configured to heat the inner space of the cooking space 30 from below, on a lower side thereof.

Additionally, the cooking space 30 may be further provided with a convection part 36 configured to heat the inner space of the cooking space 30 as a result of convection of hot air, on a rear side thereof. The convection part 36 may include a convection motor 36*a*, a convection fan 36*b* configured to rotate as a result of operation of the convection motor 36*a* and to allow of a flow of air in the inner space of the cooking space 30, and a convection heater 36*c* provided in a way that surrounds the convection fan 36*b* and configured to heat flowing air.

The convection part 36 may forcibly allow of a flow of air in the inner space of the cooking space 30. That is, the convection part 36 may heat and allow of the flow of the air in the inner space of the cooking space 30 to heat the inner space of the cooking space 30, thereby uniformly heating food in the inner space of the cooking space 30.

The cooking space 30 may be provided with a rack 40, on both lateral walls thereof. A vessel containing food may be held on the rack 40. To adjust a height of the vessel containing food, the rack 40 may have multiple steps as illustrated in FIG. 2.

The door 100 configured to open and close the cooking space 30 may be rotatably disposed on a front surface of the cooking appliance. The door 100 may be a pull-down type door in which an upper end of the door rotates around a lower end of the door in an up-down direction to open and close the cooking space 30.

The door 100 may be entirely formed into a cuboid having a predetermined thickness. The door 100 may be provided with a handle 150, which is gripped by a user when the user rotates the door 100, on a front surface thereof. The user may open and close the door 100 readily using the handle 150.

A control panel 51 may be disposed on a front surface of the cooktop part 20 and an upper side of the door 100. The control panel 51 may be provided with an input part 52 to which the user inputs a manipulation signal for operating devices disposed in the cooktop part 20 and the cooking space 30, on a front surface thereof.

The input part 52 may be provided with a plurality of manipulation switches such that the user may input a manipulation signal directly. A manipulation switch of the input part 52 may formed into a knob and the like, as illustrated in FIG. 1.

For example, when a heating device using gas as a fuel is used as the heating part 22, the input part 52 formed into a knob may connect to a valve adjusting part 54, and the user may adjust the valve adjusting part 54 as a result of a manipulation such as a rotation of the knob and the like to adjust an opening degree of a gas valve.

Thus, the user may ignite or extinguish a fire on the heating part 22 as result of the manipulation of the input part 52, or may adjust a flow amount of gas introduced from the outside to adjust thermal power of the heating part 22.

Further, the control panel 51 may be further provided with a display 53 configured to provide information on operation of the cooking appliance or information on cooking of a food item and the like, and the user may see various pieces of information on the cooking appliance through the display 53.

An electronic component space 50 serving as a space in which electronic components are disposed may be formed in a space between the cooktop part 20 and the cooking space 30 in the inner space of the main body 10.

Upper portions of the control panel 51 and the door 100 may be disposed on a front surface of the electronic component space 50, and the cooking appliance may have a structure in which the front surface of the electronic component space 50 is shielded by the control panel 51 and the door 100.

Figure 3:
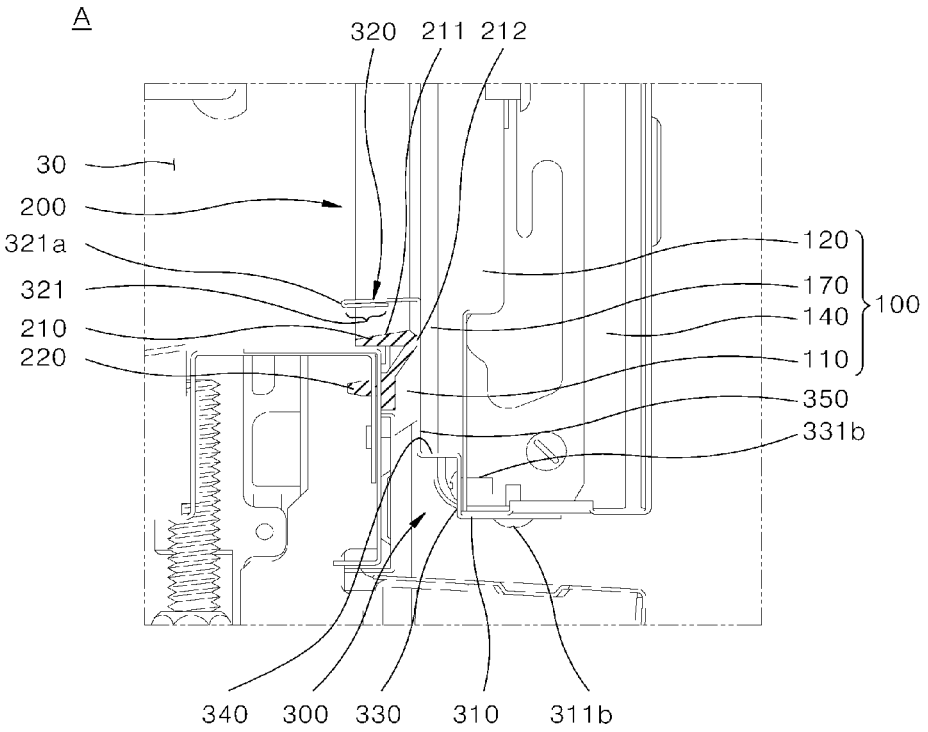
FIG. 3 is an enlarged view showing portion A in FIG. 2.
Figure 4:
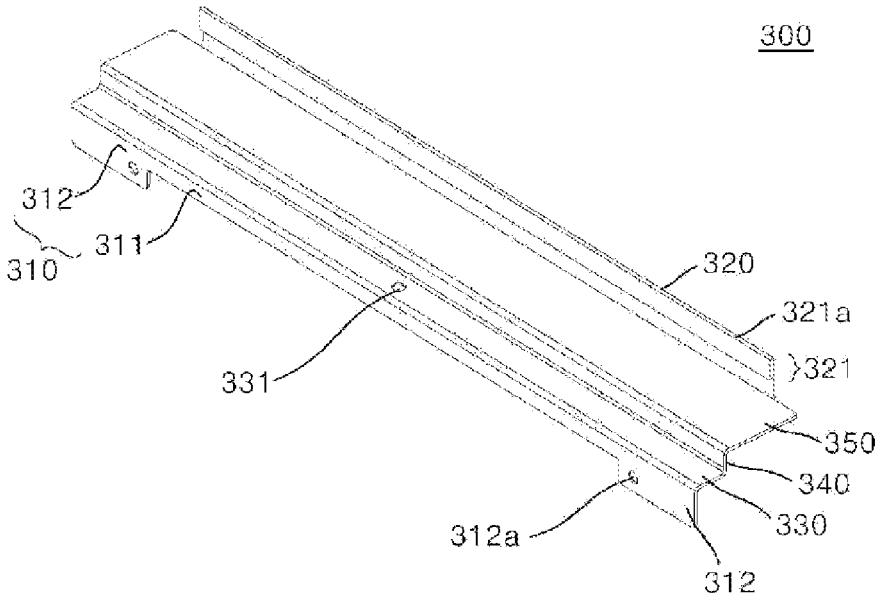
FIG. 4 is a perspective view showing a bracket in one embodiment.
Figure 5:
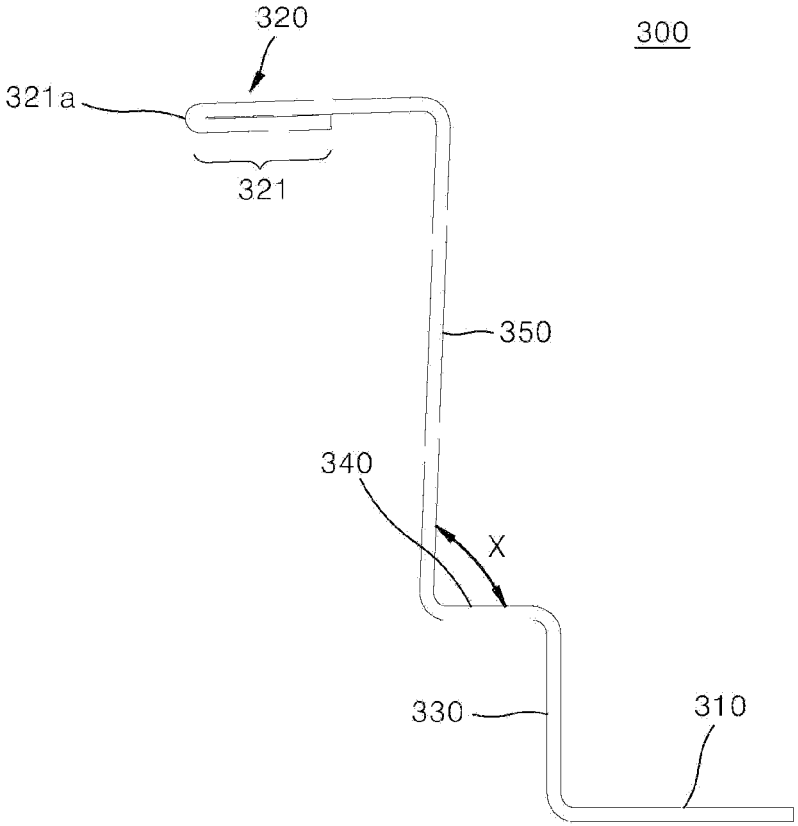
FIG. 5 is a side view showing the bracket in one embodiment.

FIG. 3 is an enlarged view showing portion A in FIG. 2. FIG. 4 is a perspective view showing a bracket 300 in one embodiment. FIG. 5 is a side view showing the bracket 300 in one embodiment.

The cooking appliance may include a packing member 200 and the bracket 300.

The packing member 200 may be disposed at an entrance of the cooking space 30, and may seal a gap that is created in a portion where the main body 10 contacts the door 100 with the door 100 closed.

The packing member 200 may be mounted onto a wall of the cooking space 30 at the entrance of the cooking space 30. When the cooking space 30 is seen front the front, the packing member 200 may be mounted onto the entrance of the cooking space 30 and may be entirely formed into a ring.

The packing member 200 may configured to be easily attached to and detached from the entrance of the cooking space 30. To this end, a lower frame 210 forming a lower end portion of the packing member 200 may have a coupling projection 220 for a coupling to a groove formed at the main body 10, as illustrated in FIG. 3. Likewise, a structure the same as or similar to the coupling projection 220 may be formed in an upper end portion of the packing member 200 and on a lateral surface of the packing member 200. The lower frame 210 may comprise an upper surface 211 formed in the front-back direction of the main body 10 and a front surface 212 formed in the vertical direction of the main body 212.

Accordingly, when the door 100 is closed, a gap formed between the entrance of the cooking space 30 and the door 100 may be sealed such that foreign substances and hot air produced in the cooking space 30 are prevented from leaking outward through the gap or such that foreign substances are prevented from coming into the cooking space 30 through the gap from the outside.

Since the packing member 200 shields the gap between the entrance of the cooking space 30 and the door 100, during a cooking process, high-temperature substances may be blocked from leaking out of the cooking appliance to protect the user, and foreign substances may be blocked from coming into the cooking space 30 through the gap from the outside to keep the inside of the cooking space 30 hygienic.

The packing member 200 may be made of a material that is lightweight, elastic and has excellent thermal resistance to seal the gap. A material having the above properties may include a silicone rubber, for example. Thus, the packing member 200 may be made of silicone rubber.

Silicone rubber does not melt even at a high temperature, and its physical properties do not change even at a high temperature. Accordingly, silicone rubber may be used for a packing means of a device that operates in a high-temperature atmosphere.

However, while food is cooked in the cooking space 30 at a high temperature, the packing member 200 may be damaged when high-temperature foreign substances produced from the food affects the packing member 200 made of silicone rubber.

For example, when meat such as chicken meat and the like is heated and cooked in the cooking space 30, chicken fat may melt in the cooking space 30, and the high-temperature melted fat may be splattered or scattered and attached to an inner glass 170 of the door 100.

A liquid or a gel-phase foreign substance that has a high temperature and high fluidity, e.g., fat of meat, on the inner glass 170 of the door 100, may flow down to a lower portion of the inner glass 170.

The high-temperature foreign substance may flow down to the lower portion of the inner glass 170, and may pile on the lower frame 210 of the packing member 200, disposed in the lower portion of the inner glass 170.

The high-temperature foreign substance gathered on the packing member 200 may chemically react with the packing member 200 in a high-temperature atmosphere. Thus, the packing member 200 may be melted, deformed or damaged. The packing member 200 made of silicone rubber, which exhibits a good heat resistance at a high temperature, may also be melted, deformed or damaged in a high-temperature atmosphere.

In the embodiment, the cooking appliance may be provided with the bracket 300 to prevent a foreign substance, having a high temperature and flowing down to the lower portion of the inner glass 170, from piling on the lower frame 210 of the packing member 200. Hereunder, the bracket 300 is specifically described.

The bracket 300 may protrude from the door 100 to the inside of the cooking space 30. The bracket 300 may form a portion of a frame which forms a structure of the door 30 and onto which various components are mounted.

The bracket 300 may be coupled to a lower portion of the door 100, and with the door 100 closed, may suppress contact between a foreign substance flowing to the lower portion of the door 100 and the packing member 200.

The bracket 300 may be formed into a structure having a plurality of bent portions. The bracket 300 may be made of a material that exhibits good elasticity and restoring force and exhibits good corrosion resistance at a high temperature.

The bracket 300 may be made of aluminum, aluminum alloys, copper, copper alloys and the like, for example. Additionally, the bracket 300 may have a coating layer, which ensures resistance against corrosion even at a high temperature, on a surface thereof.

The coating layer may be made of a material that is not deformed chemically or physically even when the coating layer is exposed at a high temperature or contacts a foreign substance in the cooking space 30.

The bracket 300 may be integrally formed in a way that a plate is bent. In one example, a metallic plate may be cut to have an exterior of the bracket 300, and bents parts may be formed on the cut plate using a bending device, to manufacture the bracket 300. In another example, the bracket 300 may be manufactured using injection molding, casting, welding and the like.

The bracket 300 may include a base part 310, an additional edge part 320, a first bent part 330, a second bent part 340 and a third bent part 350.

The base part 310 may be coupled to the lower portion of the door 100. The base part 310 may include a first cell 311 and a second cell 312.

The first cell 311 may be formed in a way that the first cell 311 is bent from the bent part. When the bracket 300 is mounted onto the door 100, the first cell 311 may be disposed approximately in a horizontal direction with respect to the cooking appliance.

A pair of second cells 312 may be provided, and may be respectively bent from both end portions of the first bent part 330 and elongated further than the first cell 311. When the bracket 300 is mounted onto the door 100, the second cell 312 may be disposed approximately in the horizontal direction with respect to the cooking appliance, like the first cell 311. The second cell 312 may be provided with a first coupling hole 312*a* for a coupling with the door 100.

The additional edge part 320 may connect to the base part 310, and with the door 100 closed, protrude in a front-rear direction of the main body 10, and overlap the lower end portion of the packing member 200, i.e., the lower frame 210 in an up-down direction of the main body 10. In this case, the additional edge part 320 may cover an upper surface 211 of the packing member 200.

Referring to FIG. 3, when the bracket 300 is mounted onto the door 100, the additional edge part 320 may be disposed approximately in the horizontal direction with respect to the cooking appliance.

When the additional edge part 320 is mounted onto the cooking appliance, the additional edge part 320 may be elongated further than a width of the lower frame 210 in a front-rear direction of the cooking appliance. Additionally, the additional edge part 320 may be disposed further upward than the lower end portion of the packing member 200, i.e., the lower frame 210, with the door 100 closed.

Referring to FIG. 3, when the additional edge part 320 and the lower frame 210 of the packing member 200 are seen from the upper portion of the door 100 with the door 100 closed, the lower frame 210 may be covered by the additional edge part 320.

With the structure, even when a foreign substance, attached to the inner glass 170 in an upper portion of the additional edge part 320 and having a high temperature and high fluidity, flows down the inner glass 170, the foreign substance may pile on the additional edge part 320 and may not flow down to the lower frame 210.

The first bent part 330 may be connected to the base part 310 and bent with respect to the base part 310. When the bracket 300 is mounted onto the door 100, the first bent part 330 may be disposed approximately in a perpendicular direction with respect to the cooking appliance.

The first bent part 330 may be provided with a third coupling hole 331 that is formed in a direction across a direction in which the first coupling hole 312*a* is formed, for a coupling with the door 100.

The second bent part 340 may be bent and extended from the first bent part 330. When the bracket 300 is mounted onto the door 100, the second bent part 340 may be disposed approximately in the horizontal direction with respect to the cooking appliance.

The third bent part 350 may be bent and extended from the second bent part 340, and one end of the third bent part 350 may connect to the additional edge part 320. When the bracket 300 is mounted onto the door 100, the third bent part 350 may be disposed approximately in the perpendicular direction with respect to the cooking appliance.

In the embodiment, the third bent part 350 may be disposed in a portion that corresponds to the packing member 200 in the up-down direction in a lower portion of an inside of the door 100 with the door 100 closed, and the bracket 300 may be disposed further upward than the lower end portion of the packing member 200. Accordingly, the bracket 300 may effectively suppress piling of high-temperature foreign substances, flowing from an inner surface of the door 100, i.e., the inner glass 170, in the lower end portion of the packing member 200.

Thus, the melting, deformation or damage of the packing member 200, caused by a direct contact between the high-temperature foreign substances and the packing member 200, may be suppressed effectively.

The additional edge part 320 may have a folded portion 321, in which a plate is folded in two in a certain portion such that one plate contacts another plate, in an end portion thereof. A part of the folded portion 321 may be disposed at an end 321*a* of the additional edge part 320, and the end 321*a* may have a round shape.

For example, the folded portion 321 may be formed in a way that a plate is folded in two. Since the additional edge part has the folded portion 321, the additional edge part 320 may have improved strength.

Due to the structure in which the additional edge part 320 protrudes from the door 100 in the front-rear direction of the cooking space 30, the additional edge part 320 may often be affected by an external impact, and as a result, may be deformed or damaged.

To prevent this from happening, the additional edge part 320 of the packing member 200 may have the folded portion 321 that is twice or greater thicker than the plate of the additional edge part 320. As a result, the additional edge part 320 may be effectively prevented from being twisted, deformed or damaged despite an external impact.

The folded portion 321 may have an end 321*a* that is rounded, and may be formed in a way that a plate is bent to form two layers in a proper portion of the additional edge part 320 and then an outside of the bent point is curved.

The additional edge part 320 may have the folded portion 321 in which the plate overlaps in two layers. The end 321*a* of the additional edge part 320, a part of the folded portion 321, may be rounded to protect the user.

The bracket 300 may be disposed in the lower portion of the inside of the door 100. Accordingly, a body part of the user may often contact the bracket 300 when the user opens or closes the door 100 to cook food.

In the embodiment, since the end of the additional edge part 320 of the packing member 200 is not thin and sharp but thick and rounded, as described above, injuries of the user may be effectively prevented even when a body part of the user contacts the end of the additional edge part 320.

As illustrated in FIG. 5, the bracket 300 may be formed to have an acute angle that is less than an angle formed by the second bent part 340 and the third bent part 350, i.e., a contained angle (X) of 90°.

The container angle (X) may be 70° to 88°, preferably, 80° to 87°, for example.

With the structure, the bracket 300 may allow at least a portion of one surface of the third bent part 350 to closely contact the inner glass 170 mounted onto the door 100, in a state of being coupled to the door 100.

When the bracket 300 is firmly coupled to the door 100 through a coupling tool, the second bent part 340 and the third bent part 350 may be elastically deformed, and the contained angle (X) may increase to about 90° although the contained angle (X) is an acute angle.

Since the second bent part 340 and the third bent part 350 are elastically deformed, the third bent part 350 may close contact a surface of the inner glass 170 of the door 100 as a result of the firm coupling between the bracket 300 and the door 100. In this case, the third bent part 350 may be disposed approximately in the perpendicular direction with respect to the cooking appliance.

With the above structure, the third bent part 350 may closely contact the surface of the inner glass 170 of the door 100, a gap between the third bent part 350 and the inner glass 170 may disappear or may be narrowed, and a high-temperature foreign substance, flowing down along the surface of the inner glass 170 of the door 100, may be effectively prevented from permeating into a gap of a portion between the bracket 300 contacts the door 100 along the gap between the third bent part 350 and the inner glass 170.

Figure 6:
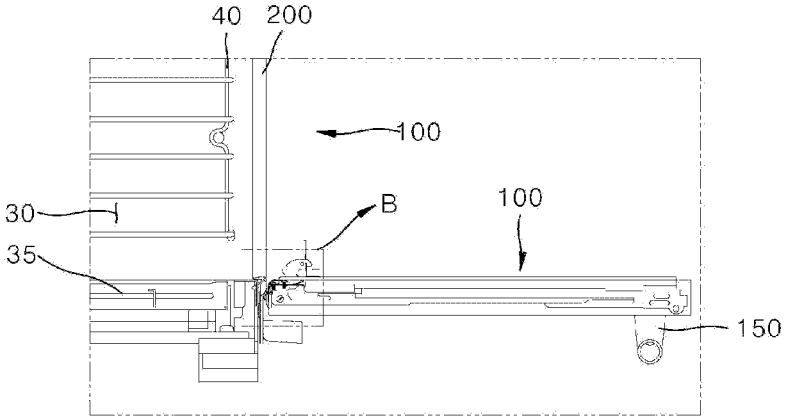
FIG. 6 is a cross-sectional view showing the cooking appliance with a door open in one embodiment.
Figure 7:
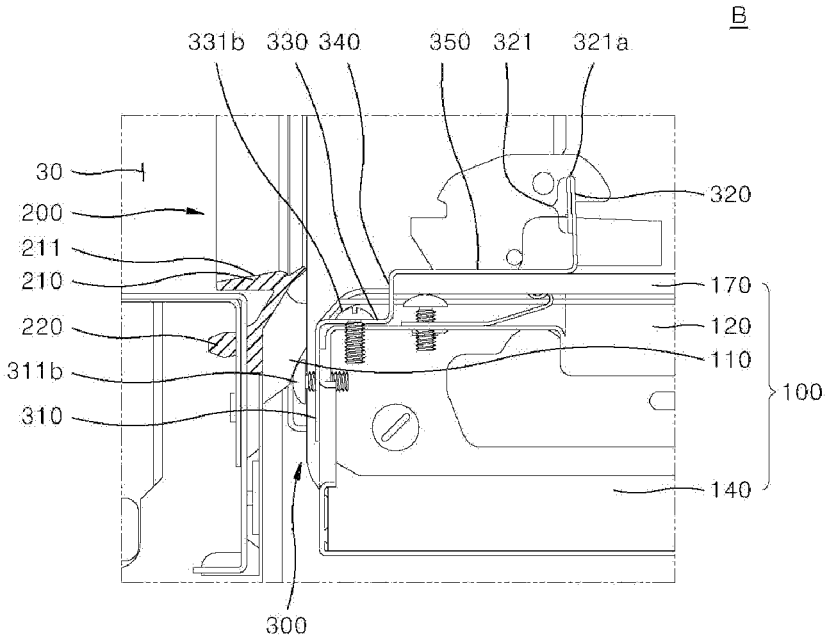
FIG. 7 is an enlarged view showing portion B in FIG. 6.
Figure 8:
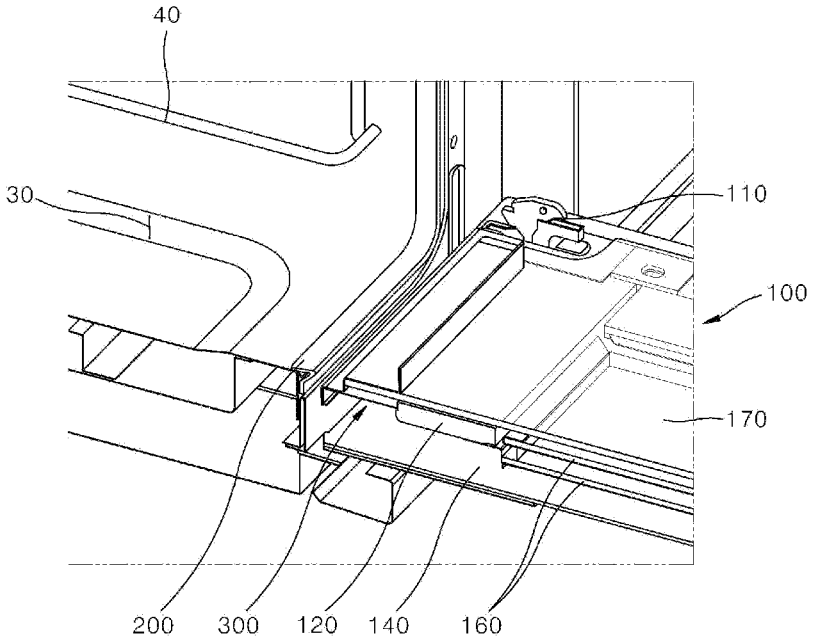
FIG. 8 is an enlarged view showing a portion of a cross section of the cooking appliance in one embodiment.

FIG. 6 is a cross-sectional view showing the cooking appliance with a door 100 open in one embodiment. FIG. 7 is an enlarged view showing portion B in FIG. 6. FIG. 8 is an enlarged view showing a portion of a cross section of the cooking appliance in one embodiment.

Referring to FIGS. 3 and 7, the bracket 300 may be firmly coupled respectively to lower portions of a lower end surface and an inner surface of the door 100 using a coupling tool such as a bolt at the base part 310 and the first bent part 330, and when the door 100 is opened and rotated to lie horizontally with respect to the cooking appliance, the bracket 300 may also be rotated.

As illustrated in FIGS. 6 to 8, in the state in which the door 100 is open and lies horizontally with respect to the cooking appliance, the additional edge part 320 may be disposed perpendicularly with respect to the cooking appliance.

In this case, the gravity-driven permeation of a foreign substance into the gap of the contact portion between the bracket 300 and the door 100 may not occur any longer, and when the cooking appliance stops operating and the door 100 is open, high-temperature foreign substances gathered on one surface of the additional edge part 320 may cool.

The user may remove the foreign substances gathered and cooled on the additional edge part 320 and remove the foreign substances flowing down from the inner glass 190 and gathered on one surface of the additional edge part 320 to block the foreign substances from permeating through the lower frame 210 of the packing member 200.

Figure 9:
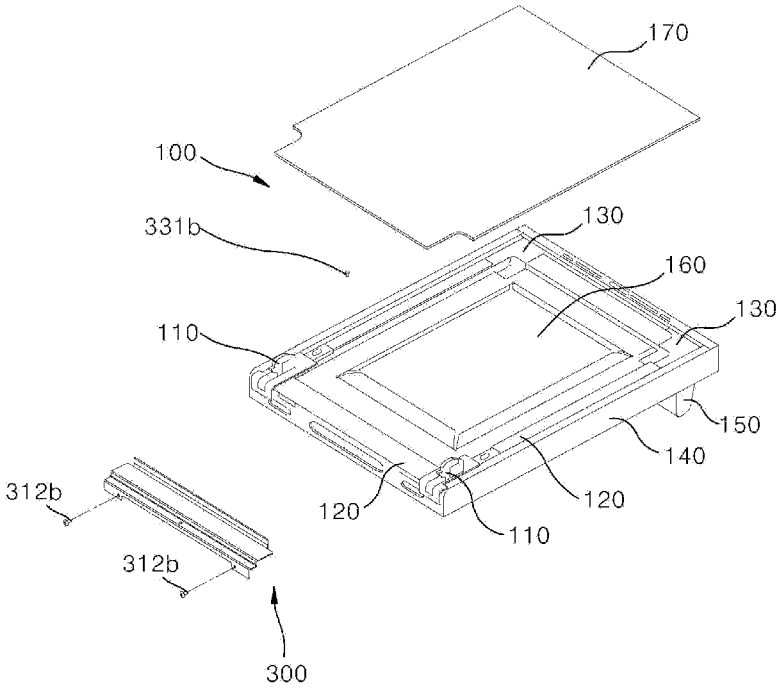
FIG. 9 is an exploded perspective view for describing a door and a bracket of the cooking appliance in one embodiment.
Figure 10:
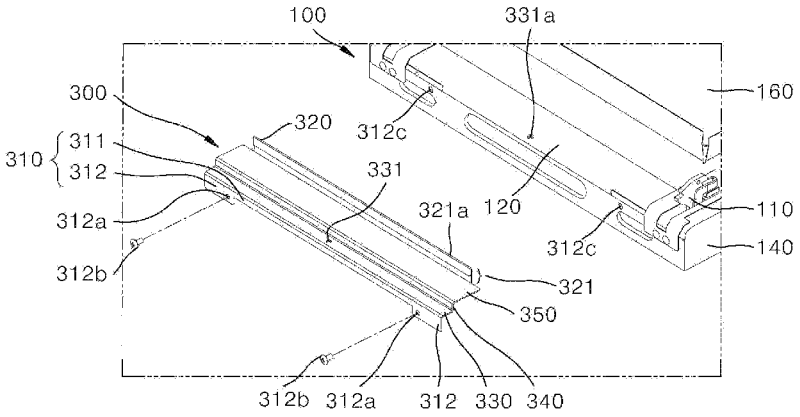
FIG. 10 is an enlarged view showing a portion of FIG. 9.

FIG. 9 is an exploded perspective view for describing a door 100 and a bracket 300 of the cooking appliance in one embodiment. FIG. 10 is an enlarged view showing a portion of FIG. 9.

The door 100 may include a locker 110, a first frame 120, a second frame 130, a handle 150, an outer glass 160 and an inner glass 170.

The locker 110 may be disposed on both sides of the bracket 300 and spaced from the bracket 300 and may keep the door 100 closed. The locker 110 may be entirely formed into a hook, and hinge-coupled to the door 100 to make a predetermined-angle rotation with respect to the door 100.

With the door 100 closed, the locker 110 may be held in a holding structure disposed at the main body 10, and accordingly, keep the door 100 closed stably.

When the door 100 is open, the locker 110 may make a predetermined-angle rotation with respect to the door 100 to escape from the holding structure disposed at the main body 10, and the user may open the door 100 using the handle 150.

The locker 110 may be mounted onto the first frame 120, and the first frame 120 may have a space in a central portion thereof. The inner glass 170 may be disposed in the central portion of the first frame 120, and the bracket 300 may be disposed in a lower portion of the first frame 120.

The first frame 120 may be formed in a way that plates having an approximate bar shape are coupled to one another, and may have various shapes to mount various types of devices and structures.

The second frame 130 may be disposed in an edge portion of the first frame 120. The second frame 130 may connect and couple the plates constituting the first frame 120, or couple the first frame 120 and a third frame 140.

The third frame 140 may have a space in a central portion thereof, surround the first frame 120 and the second frame 130, and form an exterior of the door 100. As illustrated in FIG. 1, the third frame 140 may occupy most of the exterior of the front of the cooking appliance, with the door 100 closed.

The handle 150 may be mounted onto a front surface of the third frame 140, and the user may open and close the door 100 manually using the handle 150.

The outer glass 160 may be disposed in the central portion of the third frame 140 and disposed outside the door 100. As illustrated in FIG. 8, the outer glass 160 may be a multi-layered glass for thermal insulation.

The inner glass 170 may be disposed in the central portion of the first frame 120 and disposed inside the door 100. When the door 100 is closed, the inner glass 170 may be disposed in an entrance portion of the cooking space 30.

The outer glass 160 and the inner glass 170 may be formed into a plate and made of a transparent or translucent glass material.

When the glass is made of a transparent material, the user may see a food tem being cooked in the cooking space 30 through the inner glass 170 and the outer glass 160. A lighting device may be disposed at a proper position of the cooking space 30 such that the user sees a food item during cooking more conveniently.

The second cell 312 of the base part 310 may have a first coupling hole 312*a*. The door 100 may have a second coupling hole 312*c* for a coupling of the base part 310 in a portion corresponding to the first coupling hole 312*a*. A lower end surface of the first frame 120, i.e., the lower end surface of the door 100 may be thin, and the second coupling hole 312*c* may be formed on the lower end surface of the first frame 120, i.e., the lower end surface of the door 100.

As a result of fastening of a first coupling tool 312*b*, such as a bolt, a screw nail and the like, to the first coupling hole 312*a* and the second coupling hole 312*c*, the base part 310 of the bracket 300 may be fastened to the door 100.

The second bent part 340 may be provided with a third coupling hole 331 that is formed in a direction across a direction in which the first coupling hole 312*a* is formed. The door 100 may be provided with a fourth coupling hole 331*a* for a coupling of the first bent part 330 in a portion corresponding to the third coupling hole 331. A lower portion of a lateral surface of the first frame 120 may be thin, and the fourth coupling hole 331*a* may be formed in the lower portion of the lateral surface of the first frame 120.

As a result of fastening of a second coupling tool 331*b*, such as a bolt, a screw nail and the like, to the third coupling hole 331 and the fourth coupling hole 331*a*, the second bent part 340 of the bracket 300 may be fastened to the door 100.

With the structure, the first coupling tool 312*b* and the second coupling tool 331*b* may be fastened to the bracket 300 and the door 100 in a way that the first coupling tool 312*b* crosses the second coupling tool 331*b* in a lengthwise direction. Accordingly, the bracket 300 may be firmly coupled to the door 100.

Referring back to FIG. 3, the bracket 300 may be mounted onto the first frame 120 forming the lower portion of the inside of the door 100 and the lower end surface of the door 100, and may be entirely disposed in the lower portion of the door 100.

Hereunder, a structure of the bracket 300 with the door 100 closed is described unless specified otherwise.

The additional edge part 320 may be disposed higher than a lower end of the inner glass 170 with the door 100 closed. With the structure, a high-temperature foreign substance flowing down from the inner glass 170 may pile on one surface of the additional edge part 320, i.e., an upper surface of the additional edge part 320 in FIG. 3 but may not flow to the lower end of the inner glass 170.

Thus, the downward flow of the foreign substance to the lower end of the inner glass 170 and the fall of the foreign substance onto an indoor floor outside the cooking appliance, which would occur without the bracket 300 at the same time as the door 100 is opened, may be prevented.

One surface of the base part 310 may be disposed to face the lower end surface of the door 100, i.e., the lower end surface of the first frame 120, and at least a portion of one surface of the first bent part 330 may closely contact the inner surface of the door 100, i.e., an inner surface of the first frame 120.

With the door 100 closed, an upper surface of the base part 310 may face and contact the lower end surface of the door 100. In this case, when the first coupling tool 312*b* is firmly fastened, the upper surface of the base part 310 may closely contact the lower end surface of the door 100. Accordingly, a foreign substance may be effectively prevented from permeating into a gap of a portion in which the base part 310 contacts the door 100.

Additionally, the upper surface of the base part 310 may be disposed on a flat surface that is disposed in a direction approximately perpendicular to the gravitational direction. Thus, a gravity-driven flow of a foreign substance, permeating into the upper surface of the base part 310, to the lower portion of the door 100 may be suppressed.

When the second coupling tool 331*b* is firmly fastened, one surface of the first bent part 330 may closely contact one surface of the door 100. Accordingly, a foreign substance may be effectively prevented from permeating into a gap of a portion in which the first bent part 330 contacts the door 100.

One surface of the second bent part 340 may be disposed to face the lower end surface of the inner glass 170, and at least a portion of one surface of the third bent part 350 may closely contact one surface of the inner glass 170.

An upper surface of the second bent part 340 may be disposed on a flat surface that is disposed in the direction approximately perpendicular to the gravitational direction. Thus, a gravity-driven flow of a foreign substance, permeating through the upper surface of the second bent part 340, to the lower portion of the door 100 may be suppressed.

As described above, the contained angle (X) between the second bent part 340 and the third bent part 350 may be an acute angle. Accordingly, the third bent part 350 may closely contact one surface of the inner glass 170 as a result elastic deformation when the bracket 300 is coupled to the door 100.

Thus, the permeation of a foreign substance flowing down along the surface of the inner glass 170 into the gap of the contact portion between the third bent part 350 and the inner glass 170 may be effectively suppressed.

In the embodiment, the bracket 300 may have a plurality of bent portions. When the bracket 300 is firmly coupled to the door 100, the bent portions may closely contact the surface of the door 100 or be disposed approximately in the horizontal direction with respect to the cooking appliance. Thus, a flow of a high-temperature foreign substance, flowing down along the surface of the inner glass 170, to the packing member 200 along the gap of the contact portion between the bracket 300 and the door 100 may be effectively suppressed.

The embodiments are described above with reference to a number of illustrative embodiments thereof. However, the present disclosure is not intended to limit the embodiments and drawings set forth herein, and numerous other modifications and embodiments can be devised by one skilled in the art without departing from the technical spirit of the disclosure. Further, the effects and predictable effects based on the configurations in the disclosure are to be included within the range of the disclosure though not explicitly described in the description of the embodiments.

| | |
|---|---|
| 10: Main body | 20: Cooktop part |
| 21: Upper plate | 22: Heating part |
| 30: Cooking space | 34: Upper heater |
| 35: Lower heater | 36: Convection part |
| 36a: Convection motor | 36b: Convection fan |
| 36c: Convection heater | 40: Rack |
| 50: Electronic component space | 51: Control panel |
| 52: Input part | 53: Display |
| 54: Valve adjusting part | 100: Door |
| 110: Locker | 120: First frame |
| 130: Second frame | 140: Third frame |
| 150: Handle | 160: Outer glass |
| 170: Inner glass | 200: Packing member |
| 210: Lower frame | 220: Coupling projection |
| 300: Bracket | 310: Base part |
| 311: First cell | 312: Second cell |
| 312a: First coupling hole | 312b: First coupling tool |
| 312c: Second coupling hole | 320: Additional edge part |
| 321: Folded portion | 321a: End of folded portion |
| 330: First bent part | 331: Third coupling hole |
| 331a: Fourth coupling hole | 331b: Second coupling tool |
| 340: Second bent part | 350: Third bent part |
| X: Contained angle | |

What is claimed is:

1. A cooking appliance, comprising:

a main body that defines a cavity for a cooking space;

a door disposed at a front surface of the main body and configured to open and close the cavity, the door including an outer glass and an inner glass mounted on the door;

a packing member provided at an entrance of the cavity, and configured to shield a gap located between a portion of the main body that defines the cavity and the door with the door closed; and a bracket coupled to a lower portion of the door and configured to suppress contact between the packing member and a foreign substance moving to the lower portion of the door with the door closed, the bracket configured as a single piece separate from the door, comprising:

a base part coupled to the lower portion of the door, a first bent part extending from the base part and bent with respect to the base part;

a second bent part extending from the first bent part and bent with respect to the first bent part, a third bent part extending parallel to the inner glass from the second bent part, the third bent part extending toward an upper end of the inner glass and bent with respect to the second bent part, at least a portion of one surface of the third bent part is located on and in contact with the inner glass, and an additional edge part extending from an end of the third bent part in a direction that intersects with the inner glass, the additional edge part disposed higher than a lower end of the inner glass opposite to the upper end of the inner glass, the additional edge part protruding in the direction that intersects with the inner glass, and disposed in a horizontal direction with respect to the cooking appliance when the door is closed such that the additional edge part covers an upper surface of the packing member.

2. The cooking appliance of claim 1, wherein a plate structure is bent to form the bracket such that the base part, the first bent part, the second bent part, the third bent part, and the additional bent part of the bracket are integrally formed in a way that the plate is bent, and the additional edge part includes a folded portion in which a portion of the plate is folded such that the folded portion contacts with an end portion of the additional edge part.

3. The cooking appliance of claim 2, wherein a portion of the folded portion that is disposed at an end of the additional edge part, and the end of the additional edge part is rounded.

4. The cooking appliance of claim 1, wherein an acute angle is formed by the second bent part and the third bent part of the bracket, and in a state in which the bracket is coupled to the door.

5. The cooking appliance of claim 1, the base part, comprising:

a first cell bent from the first bent part; and a pair of second cells bent in both end portions of the first bent part respectively and elongated further than the first cell, wherein the second cell comprises a first coupling hole that is configured to couple with the door, and the door comprises a second coupling hole that is configured to couple with the base part at a portion corresponding to the first coupling hole.

6. The cooking appliance of claim 5, wherein the first bent part comprises a third coupling hole that is configured to couple with the door, and wherein the door comprises a fourth coupling hole that is configured to couple with the first bent part at a portion corresponding to the third coupling hole.

7. The cooking appliance of claim 1, the door, comprising:

a locker disposed at both sides of the bracket and spaced from the bracket, and configured to keep the door closed;

a first frame on which the locker is mounted, which has a space in a central portion thereof, and at which the bracket is disposed;

a second frame disposed at an edge portion of the first frame;

a third frame having a space formed in a central portion thereof, surrounding the first frame and the second frame, and forming an exterior surface of the door, a handle mounted onto the third frame;

the outer glass disposed in the central portion of the third frame and disposed outside the door; and the inner glass disposed in the central portion of the first frame and disposed inside the door.

8. The cooking appliance of claim 7, wherein a surface of the base part is disposed to face a lower end surface of the door, and at least a portion of a surface of the first bent part contacts an inner surface of the door.

9. The cooking appliance of claim 8, wherein a surface of the second bent part is disposed to face a lower end surface of the inner glass, and at least a portion of a surface of the third bent part contacts a surface of the inner glass.

10. The cooking appliance of claim 1, wherein the packing member is attached to a wall of the main body that defines the cavity.

11. The cooking appliance of claim 1, wherein a portion of the additional edge part is folded such that an end of the additional edge part is rounded.

12. A cooking appliance, comprising:

a main body that defines a cavity for a cooking space;

a door disposed at a front surface of the main body and configured to open and close the cavity, the door including an outer glass and an inner glass mounted on the door;

a packing member provided at an entrance of the cavity, and configured to shield a gap located between a portion of the main body that defines the cavity and the door with the door closed; and a bracket coupled to a lower portion of the door and configured to suppress contact between the packing member and a foreign substance moving to the lower portion of the door with the door closed, the bracket configured as a single piece separate from the door, comprising:

a base part coupled to the lower portion of the door, a first bent part extending from the base part and bent with respect to the base part, a second bent part extending from the first bent part and bent with respect to the first bent part, and a third bent part extending from the second bent part and bent with respect to the second bent part, the third bent part having one end connected to the additional edge part, the additional edge part protruding in a direction that intersects with the inner glass, and disposed in a horizontal direction with respect to the cooking appliance when the door is closed such that the additional edge part covers an upper surface of the packing member, wherein a plate structure is bent to form the bracket such that the base part, the first bent part, the second bent part, the third bent part, and the additional bent part of the bracket are integrally formed in a way that the plate is bent, and the additional edge part includes a folded portion in which the plate is folded such that one end section of the plate contacts with a section of the additional edge part, and an end of the additional edge part is rounded.

13. The cooking appliance of claim 12, wherein an acute angle is formed by the second bent part and the third bent part, and in a state in which the bracket is coupled to the door, at least a portion of a surface of the third bent part is over the inner glass and contacts the inner glass, and the additional edge part is disposed higher than a lower end of the inner glass when the door is closed.

14. The cooking appliance of claim 12, wherein a surface of the base part is disposed to face a lower end surface of the door, at least a portion of a surface of the first bent part contacts an inner surface of the door, a surface of the second bent part is disposed to face a lower end surface of the inner glass, and at least a portion of a surface of the third bent part contacts a surface of the inner glass.

* * * * *